US005710862A

United States Patent [19]

Urbanski

[11] Patent Number: 5,710,862

[45] Date of Patent: Jan. 20, 1998

[54] METHOD AND APPARATUS FOR REDUCING AN UNDESIRABLE CHARACTERISTIC OF A SPECTRAL ESTIMATE OF A NOISE SIGNAL BETWEEN OCCURRENCES OF VOICE SIGNALS

[75] Inventor: Steven Adam Urbanski, Round Lake Beach, Ill.

[73] Assignee: Motorola, Inc., Schaumburg, Ill.

[21] Appl. No.: 85,693

[22] Filed: Jun. 30, 1993

[51] Int. Cl.[6] ..... G10L 9/00

[52] U.S. Cl. ..... 395/2.35; 395/217

[58] Field of Search ..... 395/2.35–2.37, 395/2.14–2.19, 2.23, 2.24, 2, 2.1, 2.42; 381/41, 46, 47, 49, 50, 71, 94

[56] References Cited

U.S. PATENT DOCUMENTS

| | | | |
|---|---|---|---|
| 4,331,837 | 5/1982 | Soumagne | 395/2.24 |
| 4,346,262 | 8/1982 | Willems et al. | 395/2.18 |
| 4,630,300 | 12/1986 | Kang et al. | 395/2.17 |
| 4,700,361 | 10/1987 | Todd et al. | 395/2.35 |
| 4,726,037 | 2/1988 | Jayant | 381/30 |
| 4,759,071 | 7/1988 | Heide | 381/47 |
| 5,007,094 | 4/1991 | Hsueh et al. | 381/47 |
| 5,012,519 | 4/1991 | Adlersberg et al. | 381/47 |
| 5,295,225 | 3/1994 | Kane et al. | 395/2.35 |
| 5,459,813 | 10/1995 | Klayman | 395/2.14 |
| 5,473,727 | 12/1995 | Nishiguchi et al. | 395/2.35 |
| 5,479,560 | 12/1995 | Mekata | 395/2.35 |

FOREIGN PATENT DOCUMENTS

0458615A2 11/1991 European Pat. Off. .

OTHER PUBLICATIONS

EIA/TIA Interim Standard, Cellular System Dual–Mode Mobile Station–Base Station Compatibility Standard, IS–54–B, Apr. 1992, pp. 1–52.

Steven M. Kay, "Noise Compensation for Autoregressive Spectral Estimate", IEEE Transactions on Acoustics, Speech and Signal Processing, vol. ASSP–28, No. 3, Jun. 1980, pp. 292–303.

Tohkura, et al., "Spectral Smoothing Technique in PARCOR Speech Analysis–Synthesis", IEEE Transactions on Acoustics, Speech and Signal Processing, vol. ASSP–26, No. 6, Dec. 1978, pp. 587–596.

*Primary Examiner*—Allen R. MacDonald
*Assistant Examiner*—Susan Wieland
*Attorney, Agent, or Firm*—Kevin D. Kaschke

[57] ABSTRACT

An improved method and an apparatus for reducing an undesirable characteristic of a spectral estimate of a noise signal (203) between occurrences of voice signals (202) in an input signal (117). A spectrum of the input signal (117) is estimated to produce a spectral estimate (119) of the input signal (117) including the undesirable characteristic of the noise signal (203). The spectrum of the input signal (117) is smoothed over a first bandwidth (f3–f4) during the occurrences of the voice signals (203) and over a second bandwidth (f2–f5), substantially greater than the first bandwidth (f3–f4), between the occurrences of the voice signals (203). Alternatively, the spectral estimate (119) of the input signal (117) is filtered between the occurrences of the voice signals (203). Alternatively, the significance of magnitude and/or phase components of poles (301–305), representing the spectral estimate (119) of the input signal (117), between the occurrences of the voice signals (203) is reduced to produce a modified spectral estimate (120) of the input signal (117) between the occurrences of the voice signals (203).

31 Claims, 5 Drawing Sheets

COMMUNICATION UNIT
100

ENCODER
103
DECODER
107
SPECTRAL ANALYZER
111
DUPLEXER
123
110
CONTROLLER
109
124
TX
104
RX
108
122
126
A/D CONVERTER
102
116
101
D/A CONVERTER
106
129
105
117
SPECTRAL SMOOTHER
112
118
SPECTRAL ESTIMATOR
113
119
FILTER
114
120
130
VOICE ACTIVITY DETECTOR
115
121
128
127

METHOD AND APPARATUS FOR REDUCING AN UNDESIRABLE CHARACTERISTIC OF A SPECTRAL ESTIMATE OF A NOISE SIGNAL BETWEEN OCCURRENCES OF VOICE SIGNALS

FIELD OF THE INVENTION

The present invention relates generally to a communication unit performing spectral analysis of an input signal including a noise signal and occurrences of voice signals, and more particularly to a method and an apparatus for reducing an undesirable characteristic of the spectral estimate of the noise signal between the occurrences of the voice signals.

BACKGROUND OF THE INVENTION

The basic operation and structure of communication systems, such as cellular radio telephone systems communication systems and land mobile communication systems, are well known in the art. Communication systems typically comprise a plurality of communication units including a plurality of subscriber units, a predetermined number of base units (or repeaters) located throughout a geographic region and a controller. The subscriber units may be vehicle mounted or portable units. The subscriber units and the base units each comprise either a transmitter or a receiver or both to form transceiver. The subscriber units are coupled to the base units by a communication channel over which modulated signals, such as radio frequency (RF) signals, are transmitted and/or received. The controller comprises a centralized call processing unit or a network of distributed controllers working together to establish communication paths for the communication units in the communication system.

More particularly, the communication units may include at least one of an encoder and a decoder as is well known in the art. An encoder is used to convert a signal from one form to another and is well known in the art. A decoder also converts a signal from one form to another and is primarily used to reverse the conversion of an encoder. Vector Sum Excited Linear Prediction (VSELP) is one of many ways to encode and decode signals. Some encoders and decoders, such as VSELP, perform spectral analysis on an input signal. The input signal includes a noise signal and occurrences of voice signals. The noise signal is generally characterized as a wide-sense stationary signal as defined in the art. During spectral analysis, the spectrum of the input signal is estimated to produce a spectral estimate of the input signal.

Unfortunately, spectral analysis of the input signal produces an undesirable characteristic of the noise signal as well as a spectral estimate of the input signal. During normal conversations, the undesirable characteristic of the noise signal is more prominent between the occurrences of the voice signals than during the occurrences of the voice signals. The sound produced by the undesirable characteristic of the noise signal is generally described as faint musical tones moving in the background of the noise signal or as the sound bubbles make when heard underwater. This sound is undesirable and degrades the quality of communication between communication units. This undesirable characteristic of the noise signal is generally described by the term "swirlies" for the sound that it produces.

Prior art techniques may be implemented in a communication unit to reduce the undesirable characteristic of the noise signal. A first technique for reducing the undesirable characteristic of the noise signal involves attenuating the input signal between the occurrences of the voice signals. However, this is undesirable because a user of the communication unit can hear the noise switching in and out which makes it difficult for the user to communicate. A second technique for reducing the undesirable characteristic of the noise signal involves removing the noise from the input signal. In theory, this works well but also adds tremendous complexity. However, in practice, the noise signal can never be completely removed and therefore produces the same undesirable characteristic of the noise signal.

Therefore, there is a need for an improved method and apparatus for reducing the undesirable characteristic of the noise signal between the occurrences of the voice signals to overcome the deficiencies of the prior art techniques.

BRIEF DESCRIPTION OF THE DRAWINGS

The present invention will be better understood when read in light of the accompanying drawings in which.

SUMMARY OF THE INVENTION

The foregoing needs and others are met with an improved method and an apparatus for reducing an undesirable characteristic of a spectral estimate of a noise signal between occurrences of voice signals in an input signal.

During spectral analysis of an input signal, a spectrum of the input signal is estimated to produce a spectral estimate of the input signal including an undesirable characteristic of the noise signal. The spectrum of the input signal is processed over a first bandwidth during the occurrences of the voice signals and over a second bandwidth, substantially greater than the first bandwidth, between the occurrences of the voice signals. Alternatively, the spectral estimate of the input signal is filtered between the occurrences of the voice signals to produce a filtered spectral estimate of the input signal between the occurrences of the voice signals.

From another viewpoint, the significance of magnitude and/or phase components of poles, representing the spectral estimate of the input signal, between the occurrences of the voice signals is reduced to produce a modified spectral estimate of the input signal between the occurrences of the voice signals. In a preferred embodiment of the present invention, reduction of the significance of the magnitude of the poles is accomplished by smoothing the spectrum of the input signal over a first bandwidth during the occurrences of the voice signals and over a second bandwidth, substantially greater than the first bandwidth, between the occurrences of the voice signals. Alternatively, reduction of the significance of the magnitude of the poles is accomplished by filtering the spectral estimate of the input signal between the occurrences of the voice signals to produce a filtered spectral estimate of the input signal between the occurrences of the voice signals.

DETAILED DESCRIPTION OF THE PREFERRED EMBODIMENTS

Generally, the present invention provides a method and an apparatus for reducing an undesirable characteristic of the spectral estimate of a noise signal between occurrences of voice signals in an input signal. The present invention advantageously smooths the noise signal over a first bandwidth during the occurrences of the voice signals and over a second bandwidth, substantially greater than the first bandwidth, between the occurrences of the voice signals 203. Alternatively, a spectral estimate of the input signal is advantageously filtered between the occurrences of the voice signals. From another point of view, the significance of magnitude and/or phase components of poles, representing the spectral estimate of the input signal, between the occurrences of the voice signals is advantageously reduced to produce a modified spectral estimate of the input signal between the occurrences of the voice signals.

The present invention can be better understood when read in light of the accompanying drawings in FIGS. 1–7.

Figure 1:
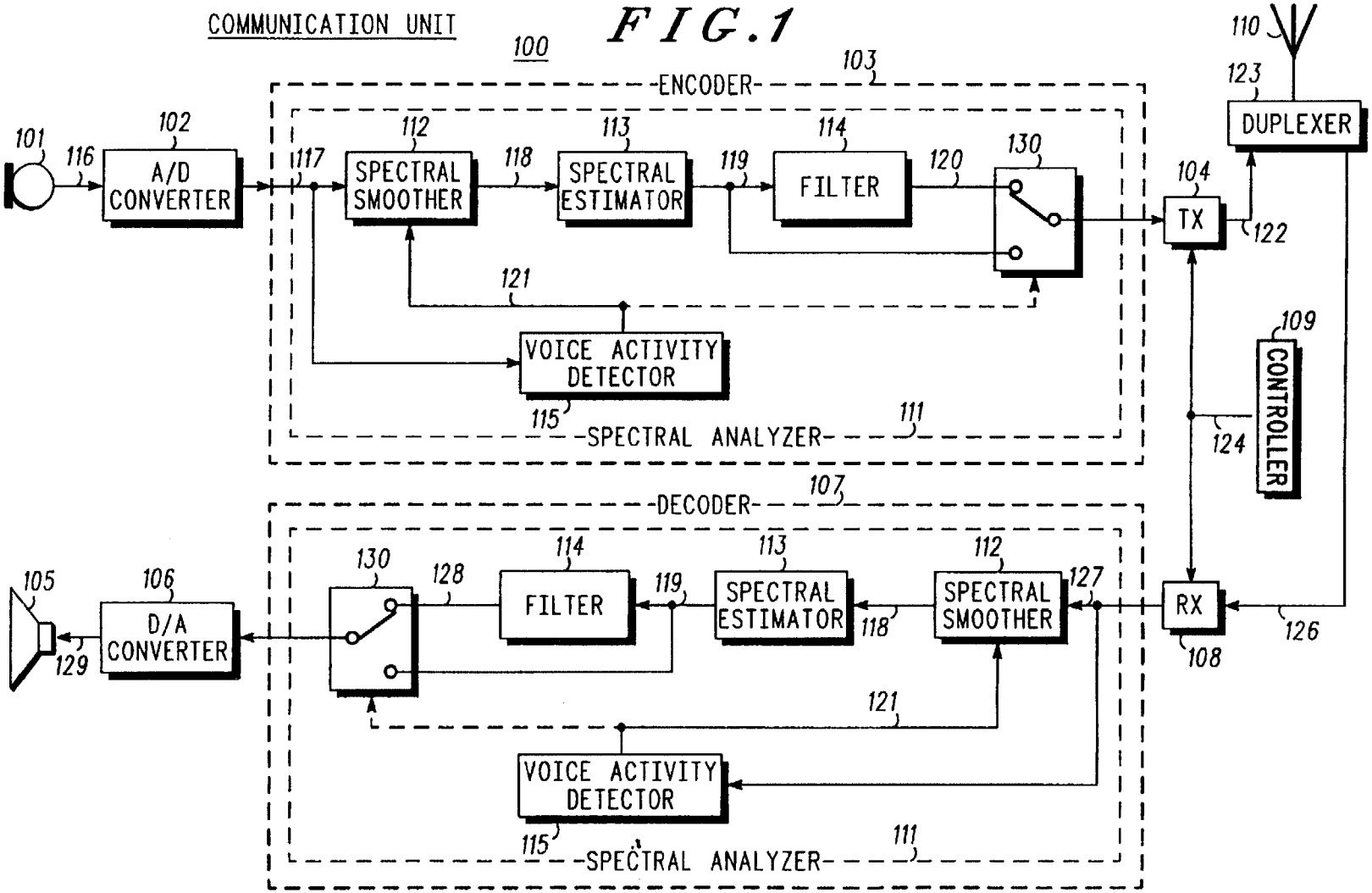
FIG. 1 illustrates a communication unit including a spectral analyzer having an input signal in accordance with the present invention.

FIG. 1 illustrates a communication unit 100 including a spectrum analyzer 111 having an input signal in accordance with the present invention. The communication unit 100 generally comprises a microphone 101, a analog to digital converter 102, an encoder 103, a transmitter 104, a speaker 105, a digital to analog converter 106, a decoder 107, a receiver 108, a controller 109, an antenna 110 and a duplexer 123. Individually, the microphone 101, the analog to digital converter 102, the encoder 103, the transmitter 104, the speaker 105, the digital to analog converter 106, the decoder 107, the receiver 108, the controller 109, the antenna 110 and the duplexer 123 are well known in the art, thus no further discussion will be presented except to facilitate the understanding of the present invention. A detailed description of the encoder and the decoder can be found in the EIA/TIA IS-54 publication "Cellular System Dual-Mode Mobile Station-Base Station Compatibility Standard", April 1992.

In the present invention, the communication unit 100 may be either a subscriber unit or a base unit as previously described.

The encoder 103 and decoder 107 generally comprises a novel spectral analyzer 111 including a spectral smoother 112, a spectral estimator 113, a filter 114, a switch 130 and a voice activity detector 115. Individually, the spectral smoother 112, the spectral estimator 113, the filter 114, the switch 130 and the voice activity detector 115 are well known in the art, thus no further discussion will be presented except to facilitate the understanding of the present invention. The signals associated with the novel spectral analyzer 111 will be described and illustrated in more detail below, in accordance with the present invention.

Figure 2:
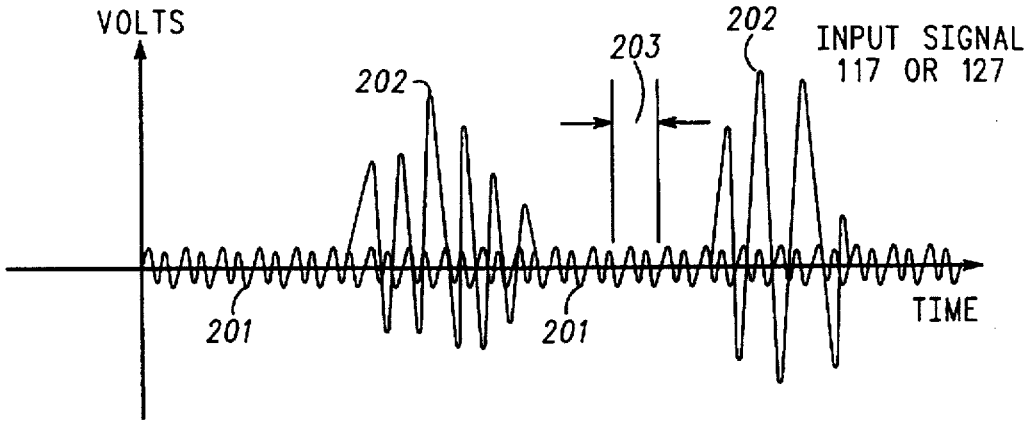
FIG. 2 illustrates a plot of the input signal of FIG. 1 including a noise signal and occurrences of voice signals in accordance with the present invention.

The following text generally describes a functional relationship between the spectral smoother 112, the spectral estimator 113, the filter 114, and the voice activity detector 115 of the spectral analyzer 111, in accordance with the present invention. The spectral analyzer 111 has an input signal 117 including a noise signal and occurrences of voice signals as previously described. FIG. 2 illustrates a plot representative of the input signal 117 of FIG. 1 including a noise signal 201 and occurrences of voice signals 202, in accordance with the present invention. The plot of the input signal is represented by volts versus time. A portion of the noise signal over a time frame is designated by reference numeral 203.

The spectral analyzer 111 performs spectral analysis of the input signal 117 to produce a spectral estimate 119 of the input signal 117 including an undesirable characteristic of the noise signal 203. The spectrum of the input signal 117 is processed, using the spectral smoother 112 for example, over a first bandwidth during the occurrences of the voice signals 202 and over a second bandwidth, substantially greater than the first bandwidth, between the occurrences of the voice signals 202. The effect of the spectral smoother 112 on the input signal 117 over the first and second bandwidths will be described and illustrated in more detail below, in accordance with the present invention.

Alternatively, the spectral estimate 119 of the input signal 117 is filtered between the occurrences of the voice signals 202 to produce a filtered spectral estimate 120 of the input signal 117 between the occurrences of the voice signals 202. The effect of the filter 114 on the spectral estimate 119 of the input signal 117 will be described and illustrated in more detail below, in accordance with the present invention.

From another viewpoint, the significance of magnitude and/or phase components of poles, representing the spectral estimate 119 of the input signal 117, between the occurrences of the voice signals 202 is reduced to produce a modified spectral estimate 120 of the input signal 117 between the occurrences of the voice signals. In a preferred embodiment of the present invention, reduction of the significance of the magnitude of the poles is accomplished by smoothing the spectrum, using the spectral smoother 112, of the input signal 117 over a first bandwidth during the occurrences of the voice signals 202 and over a second bandwidth, substantially greater than the first bandwidth, between the occurrences of the voice signals 202.

Alternatively, reduction of the significance of the phase of the poles is accomplished by filtering, using the filter 114, the spectral estimate 119 of the input signal 117 between the occurrences of the voice signals 202 to produce a filtered spectral estimate 120 of the input signal 117 between the occurrences of the voice signals 202. The poles of the spectral estimate 119 of the input signal 117 will be described and illustrated in more detail below, in accordance with the present invention.

In the preferred embodiment of the present invention, the spectral smoother 112 is more generally described as a processor. Spectral smoothing, in general, is well known in the art, thus no further discussion will be presented except to facilitate the understanding of the present invention. A detailed description of spectral smoothing can be found in a paper by Y. Tohkura, F. Itakura, and S. Hashimoto, "Spectral Smoothing Technique in PARCOR Speech Analysis-Synthesis", IEEE Trans. on Acoustics, Speech, and Signal Processing, Vol. ASSP-26, No.6, December 1978.

In the preferred embodiment of the present invention, the filter 114 filters the phase and magnitude of the pole representation of the spectral estimate 119. The filter 114 effectively slows the movement of the poles of the spectral estimate 119. It does this by applying a first order low pass filter directly to the reflection coefficients of the spectral estimate 119, wherein the filter has the following transfer function:

$$H(z) = \frac{0.02}{1 - 0.98z^{-1}}$$

In the preferred embodiment of the present invention, the spectral estimator 113 is a linear predictor using an algorithm known in the art as FLAT (fixed-point lattice technique). The FLAT algorithm is well known in the art, thus no further discussion will be presented except to facilitate the understanding of the present invention. A detailed description of the FLAT algorithm can be found in the EIA/TIA IS-54 publication "Cellular System Dual-Mode Mobile Station-Base Station Compatibility Standard", April 1992.

In the preferred embodiment of the present invention, the voice activity detector 115 detects voice signals 202 in the presence of the noise signal 203 by measuring the energy of the input signal 117 and comparing it to an estimate of the energy in the noise signal 201. The voice activity detector 115 produces a control signal 121 having two states and is responsive to the presence of a voice signal 202 in the input signal 117. Voice activity detectors are well known in the art, thus no further discussion will be presented except to facilitate the understanding of the present invention.

In the preferred embodiment of the present invention, the switch is conventional and is a single pole, double throw switch operative responsive to the control signal 121.

The following text more specifically describes the functional relationship and interconnection between the spectral smoother 112, the spectral estimator 113, the filter 114, the switch 130 and the voice activity detector 115 of the spectral analyzer 111, in accordance with the preferred embodiment of the present invention. The input signal 117 is coupled to the spectral analyzer 111. In the spectral analyzer 111, the input signal is coupled to both the spectral smoother 112 and the voice activity detector 115. The voice activity detector 115 produces the control signal 121 responsive to the presence of a voice signal 202 in the input signal 117. The voice activity detector 115 produces a control signal 121 having a first state when a voice signal 202 is detected and a second state when no voice is detected. The control signal 121 is coupled to the spectral smoother 112. The spectral smoother 112 smoothes the spectrum of the input signal 117 over the first bandwidth, for example 80 Hz, responsive to the control signal 121 being in the first state. The spectral smoother 112 smoothes the spectrum of the input signal 117 over the second bandwidth, for example 1200 Hz, responsive to the control signal 121 being in the second state. Switching between the first and the second bandwidths is needed because the first bandwidth produces optimal results during the voice signals 202 and the second bandwidth produces optimal results between the voice signals 202. The second bandwidth, however, cannot be made too wide relative to the bandwidth of the input signal because the shape of the noise signal would be lost and the noise would sound unnatural. The spectral smoother 112 produces the smoothed spectrum 118 of the input signal 117. The smoothed spectrum 118 of the input signal 117 is coupled to the spectral estimator 113 which produces the spectral estimate 119 of the smoothed spectrum 118 of the input 117. Additionally, switching between the first and the second bandwidths is virtually undetectable by the user.

In accordance with an alternate embodiment of the present invention, the control signal 121 is coupled to the switch 130 instead of the spectral smoother 112. The spectral smoother 112 smoothes the spectrum of the input signal 117, only over the first bandwidth of 80 HZ for example, to produce the smoothed spectrum 118 of the input signal 117. The smoothed spectrum 118 of the input signal 117 is coupled to the spectral estimator 113 which produces the spectral estimate 119 of the smoothed spectrum 118 of the input 117. The spectral estimate 119 is coupled to the filter 114 and the switch 130. The filter 114 filters the spectral estimate 119 to produce a filtered spectral estimate 120. The switch 130 selects between the spectral estimate 119 and the filtered spectral estimate 120 responsive to the state of the control signal 121. When the control signal 121 is in the first state, the switch selects the spectral estimate 119. When the control signal 121 is in the second state, the switch selects the filtered spectral estimate 120. Switching the filter 114 in and out responsive to the control signal 121 is needed because no filtering produces optimal results during the voice signals 202 and filtering produces optimal results between the voice signals 202. Additionally, switching the filter 114 in and out is virtually undetectable by the user.

Figure 3:
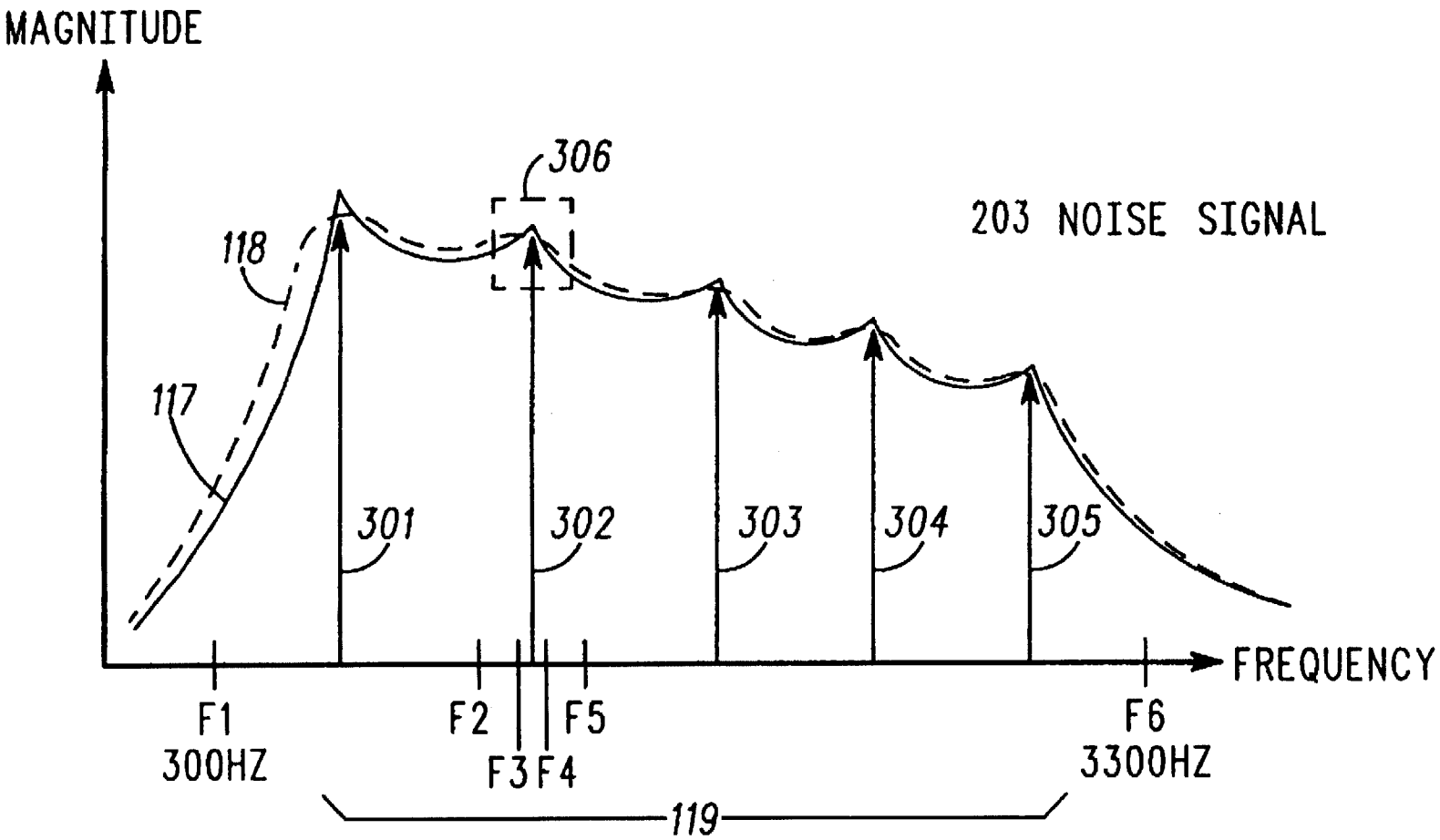
FIG. 3 illustrates a spectral plot of a portion of the noise signal of FIG. 2 in accordance with a preferred embodiment of the present invention.

FIG. 3 illustrates a spectral plot of a portion 203 of the noise signal 201 of FIG. 2 in accordance with the preferred embodiment of the present invention. The spectral plot illustrates magnitude versus frequency. The spectrum of the input signal 117, the spectrum of the smoothed input signal 118 and the spectral estimate 119 of the spectrally smoothed input signal 118 illustrate the portion 203 of the noise signal 201 at various points in the spectral analyzer 111. The spectral estimate 119 is represented by poles 301–305. The poles 301–305 have magnitude and phase components as is well known in the art. In the preferred embodiment of the present invention, the poles are defined by EIA/TIA IS-54 publication "Cellular System Dual-Mode Mobile Station-Base Station Compatibility Standard", April 1992. The frequencies f1 and f6 are 300 Hz and 3300 Hz, respectively, and represent the frequencies of interest to the spectral analyzer 111. The first frequency bandwidth used by the spectral smoother 112 is represented by f3–f4 and has a bandwidth of 80 Hz. The second frequency bandwidth used by the spectral smoother 112 is represented by f2–f5 and has a bandwidth of 1200 Hz. Area 306 is a spectral plot of a portion 203 of the noise signal 201 as will be discussed in magnified detail with FIG. 4.

Figure 4:
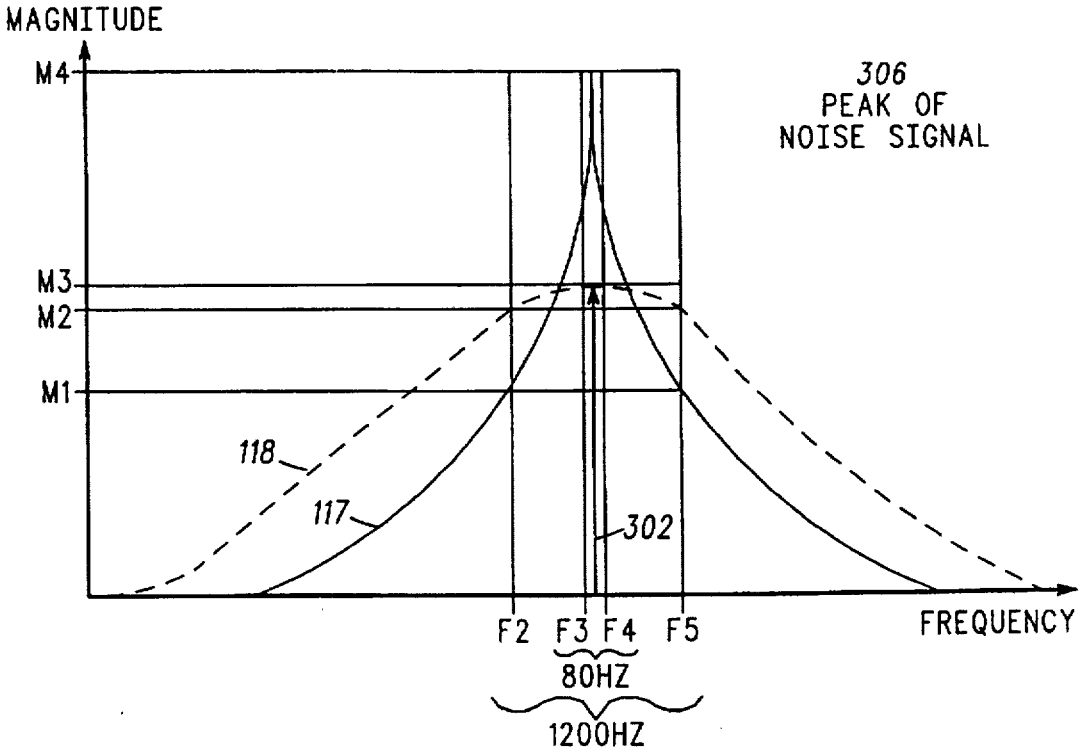
FIG. 4 illustrates a magnified spectral plot of a portion of the noise signal of FIG. 3 in accordance with the preferred embodiment of the present invention.

FIG. 4 illustrates a magnified spectral plot 306 of a portion 203 of the noise signal 201 of FIG. 3 in accordance with the preferred embodiment of the present invention. The magnified spectral plot partially illustrates the spectrum of the input signal 117, the spectrum of the smoothed input signal 118 and the spectral estimate 119 (as pole 302) of the spectrally smoothed input signal 118. In the preferred embodiment of the present invention, the magnitude M4 of the peak of the input signal 117 is reduced to a magnitude M3 of the peak of the smoothed spectrum 118 of the input signal thereby reducing the significance of the peak of the input signal 117 and ultimately smoothing the spectral shape around that peak.

It is hypothesized that the undesirable characteristic causing the "swirlies" is caused by the peak of the input signal 117 changing frequencies over time. Now, if the peak of the input signal 117 represented by pole 302 were to change its location slightly in frequency during the next spectral estimate in time, for example to f2, the difference in magnitude M3–M2 at the new location f2 is drastically lower than if it were not smoothed resulting in a difference in magnitude M4–M1. The present invention advantageously minimizes the change in the spectral shape of the portion 203 of the noise signal 201 over time giving the portion 203 of the noise signal 201 a more constant and natural sound.

Figure 5:
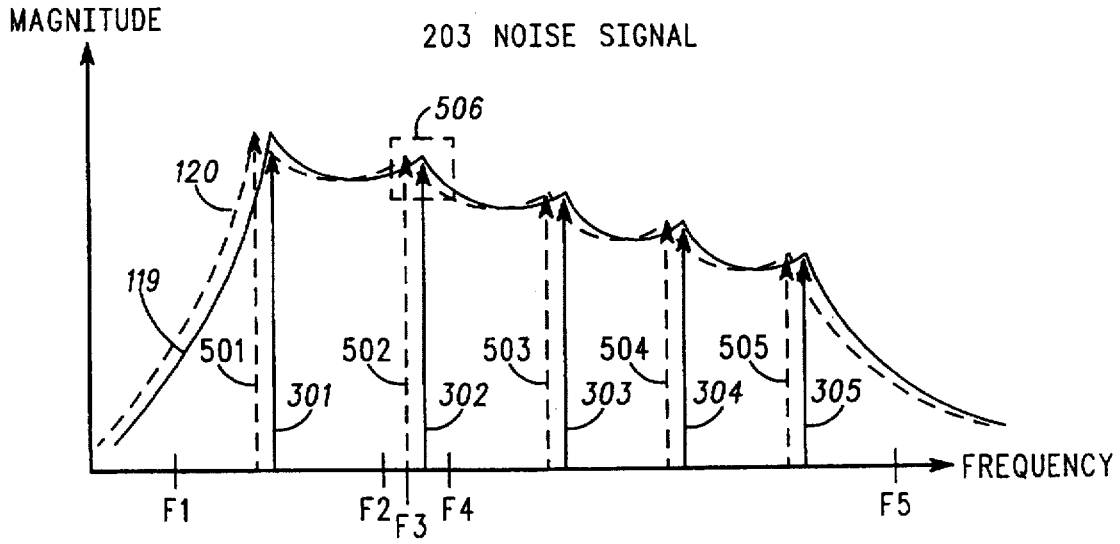
FIG. 5 illustrates a spectral plot of a portion of the noise signal of FIG. 2 in accordance with an alternate embodiment of the present invention.

FIG. 5 illustrates a spectral plot of a portion 203 of the noise signal 201 of FIG. 2 in accordance with the alternate embodiment of the present invention. The spectral plot illustrates magnitude versus frequency. The spectral estimate 119 of the spectrally smoothed input signal 118 and the filtered spectral estimate 120 illustrate the portion 203 of the noise signal 201 at the input and the output, respectively, of the filter 114 in the spectral analyzer 111. The spectral estimate 119 is represented by poles 301–305 before filtering and by poles 501–505 after filtering. The poles 301–305 and 501–505 have magnitude and phase components as is well known in the art. In the preferred embodiment of the present invention, the poles are defined by EIA/TIA IS-54 publication "Cellular System Dual-Mode Mobile Station-Base Station Compatibility Standard", April 1992. The frequencies f1 and f5 are 300 Hz and 3300 Hz, respectively, and represent the frequencies of interest to the spectral analyzer 111. Frequency f2 represents the frequency of the pole 502 of a previous filtered spectral estimate in time. Frequency f4 represents the frequency of pole 302 before filtering. Frequency f3 represents the frequency of pole 502 after filtering. Accordingly, the filter 114 filters the magnitude and the phase (i.e. frequency) of the poles over time as previously described in FIG. 1. Area 506 is a portion of the spectral plot of a portion 203 of the noise signal 201 as will be discussed in magnified detail with FIG. 6.

Figure 6:
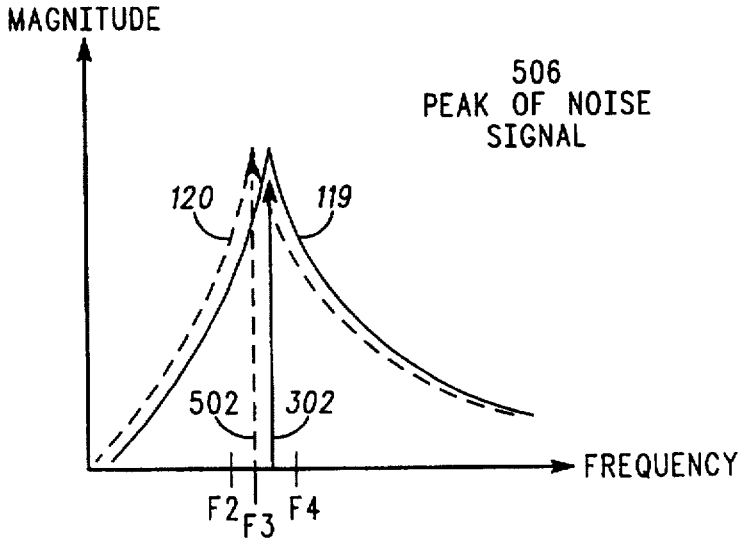
FIG. 6 illustrates a magnified spectral plot of a portion of the noise signal of FIG. 5 in accordance with the alternate embodiment of the present invention.

FIG. 6 illustrates a magnified spectral plot 506 of a portion 203 of the noise signal 201 of FIG. 5 in accordance with the alternate embodiment of the present invention. The magnified spectral plot 506 partially illustrates the spectral estimate 119 (as pole 302) of the spectrally smoothed input signal 118 and the filtered spectral estimate 120 (as pole 502) of the portion 203 of the noise signal 201 at the input and the output, respectively, of the filter 114 in the spectral analyzer 111. Filtering the spectral estimate 119 has the effect of advantageously slowing down the movement of the peaks over time. The pole movement between frequencies f2 and f3 when the filter 114 is used is much smaller than the pole movement between frequencies f2 and f4 without using the filter 114. Thus, the present invention advantageously minimizes the change in the spectral shape of the portion 203 of the noise signal 201 over time giving the portion 203 of the noise signal 201 a more constant and natural sound.

Figure 7:
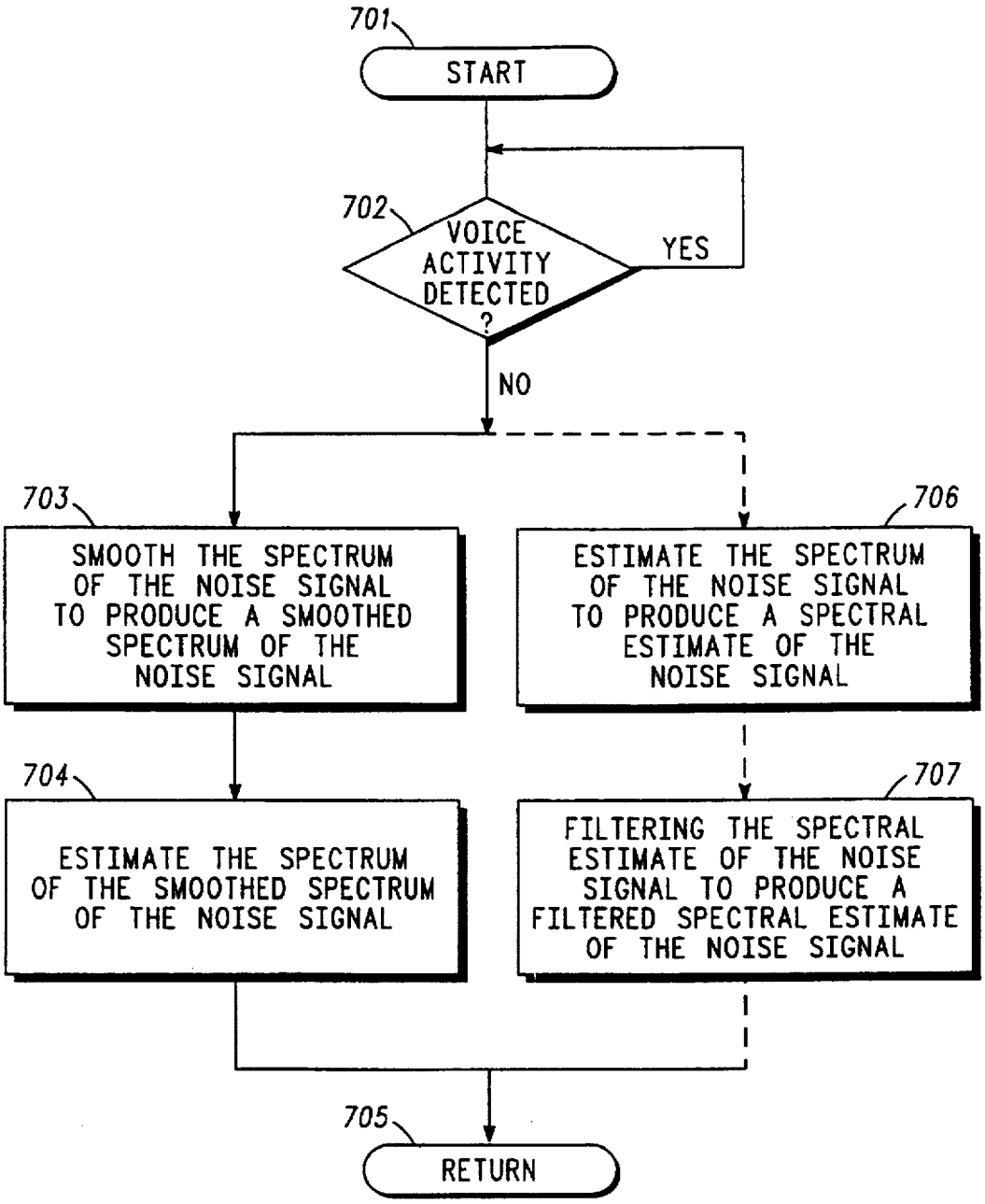
FIG. 7 illustrates a flowchart of the steps performed by the spectral analyzer of FIG. 1 in accordance with the preferred and alternate embodiments of the present invention.

FIG. 7 illustrates a flowchart of the steps performed by the spectral analyzer of FIG. 1 in accordance with the preferred and alternate embodiments of the present invention. The flow begins at step 701. At step 702, a determination is made, by the voice activity detector, if voice activity is detected in the input signal 117. If voice activity is detected at step 702, repeat step 702. If voice activity is not detected at step 702, the flow proceeds to stop 703, in the preferred embodiment. At step 703, the spectral smoother 112 smooths the spectrum of the noise signal 203 to produce a smoothed spectrum 118 of the noise signal 203. At step 704, spectral estimator 113, estimates the spectrum of the smoothed spectrum 118 of the noise signal 203. The flow returns to other processing at step 705.

In the alternate embodiment of the present invention, if voice activity is not detected at step 702, the flow proceeds to step 706. At step 706, the spectral estimator 113 estimates the spectrum of the noise signal 203 to produce a spectral estimate 119 of the noise signal 203. At step 707, the filter 114 filters the spectral estimate of the noise signal to produce a filtered spectral estimate 120 of the noise signal 203. The flow returns to other processing at step 705.

Thus, it is apparent that there is provided a method and an apparatus for reducing an undesirable characteristic of the spectral estimate of the noise signal between the occurrences of the voice signals which fully meets the needs set forth above. With the present invention the problems of switching in and out, and removing the noise signal of the prior art are substantially resolved. The present invention advantageously smooths the noise signal over a first bandwidth f3–f4 during the occurrences of the voice signals 203 and over a second bandwidth f2–f5, substantially greater than the first bandwidth f3–f4, between the occurrences of the voice signals 203. Alternatively, the spectral estimate 119 of the input signal 119 is advantageously filtered between the occurrences of the voice signals 203. From another point of view, the significance of magnitude and/or phase components of poles 301–305, representing the spectral estimate of the input signal 119, between the occurrences of the voice signals 203 is advantageously reduced to produce a modified spectral estimate 120 of the input signal 119 between the occurrences of the voice signals 203.

While the present invention has been described with reference to illustrative embodiments thereof, it is not intended that the invention be limited to these specific embodiments. Those skilled in the art will recognize that variations and modifications can be made without departing from the spirit and scope of the invention as set forth in the appended claims.

What is claimed is:

1. A method for performing spectral analysis of an input signal including a noise signal and occurrences of voice signals, the method comprising the steps of:

detecting the occurrences of voice signals in the input signal;

smoothing, responsive to the step of detecting, a spectrum of the input signal over a first bandwidth during the occurrences of the voice signals and over a second bandwidth, substantially greater than the first bandwidth, between the occurrences of the voice signals to produce a smoothed spectrum of the input signal; and estimating, responsive to the step of smoothing, a spectrum of the smoothed spectrum of the input signal to produce a spectral estimate of the smoothed spectrum of the input signal.

2. A method for performing spectral analysis of an input signal including a noise signal and occurrences of voice signals, the method comprising the steps of:

estimating a spectrum of the input signal to produce a spectral estimate of the input signal;

filtering, responsive to the step of estimating, the spectral estimate of the input signal to produce a filtered signal;

detecting the occurrences of voice signals in the input signal; and selecting, responsive to the steps of estimating, filtering and detecting, the spectral estimate of the input signal during the occurrences of the voice signals and the filtered signal between the occurrences of the voice signals.

3. A method for performing spectral analysis of an input signal including a noise signal and occurrences of voice signals, the method comprising the steps of:

producing poles representing a spectral estimate of the input signal, wherein the poles are defined by magnitude and phase components;

detecting the occurrences of voice signals in the input signal; and reducing, responsive to the steps of detecting and estimating, the significance of at least one of the magnitude and phase components of the poles between the occurrences of the voice signals to produce a modified spectral estimate of the input signal between the occurrences of the voice signals.

4. A method according to claim 3 wherein the step of reducing the significance of the magnitude of the poles further comprises the step of:

smoothing, responsive to the step of detecting, the spectrum of the input signal over a first bandwidth during the occurrences of the voice signals and over a second bandwidth, substantially greater than the first bandwidth, between the occurrences of the voice signals to produce a smoothed spectrum of the input signal.

5. A method according to claim 3 wherein the step of reducing the significance of the phase of the poles further comprises the steps of:

filtering, responsive to the step of estimating, the spectral estimate of the input signal to produce a filtered signal; and selecting, responsive to the steps of detecting, estimating and filtering, the spectral estimate of the input signal during the occurrences of the voice signals and the filtered signal between the occurrences of the voice signals.

6. A spectral analyzer for performing spectral analysis of an input signal including a noise signal and occurrences of voice signals, the spectral analyzer comprising:

a voice activity detector for detecting the occurrences of voice signals in the input signal;

a spectral smoother, coupled to the voice activity detector, for smoothing a spectrum of the input signal over a first bandwidth during the occurrences of the voice signals and over a second bandwidth, substantially greater than the first bandwidth, between the occurrences of the voice signals to produce a smoothed spectrum of the input signal; and a spectral estimator, coupled to the spectral smoother, for estimating a spectrum of the smoothed spectrum of the input signal to produce a spectral estimate of the smoothed spectrum of the input signal.

7. A spectral analyzer for performing spectral analysis of an input signal including a noise signal and occurrences of voice signals, the spectral analyzer comprising:

a spectral estimator for estimating a spectrum of the input signal to produce a spectral estimate of the input signal;

a filter, coupled to the spectral estimator, for filtering the spectral estimate of the input signal to produce a filtered signal;

a voice activity detector for detecting the occurrences of voice signals in the input signal; and a switch, coupled to the voice activity detector, the spectral estimator and the filter, for selecting the spectral estimate of the input signal during the occurrences of the voice signals and the filtered signal between the occurrences of the voice signals.

8. A spectral analyzer for performing spectral analysis of an input signal including a noise signal and occurrences of voice signals, the spectral analyzer comprising:

a spectral estimator for producing poles representing a spectral estimate of the input signal, wherein the poles are defined by magnitude and phase components;

a voice activity detector for detecting the occurrences of voice signals in the input signal; and a pole component reducer, coupled to the spectral estimator and the voice activity detector, for reducing the significance of at least one of the magnitude and phase components of the poles between the occurrences of the voice signals to produce a modified spectral estimate of the input signal between the occurrences of the voice signals.

9. A spectral analyzer according to claim 8 wherein the pole component reducer further comprises:

a spectral smoother, coupled to an input of the spectral estimator and the voice activity detector, for smoothing the spectrum of the input signal over a first bandwidth during the occurrences of the voice signals and over a second bandwidth, substantially greater than the first bandwidth, between the occurrences of the voice signals to produce a smoothed spectrum of the input signal.

10. A spectral analyzer according to claim 8 wherein the pole component reducer further comprises:

a filter, coupled to an output of the spectral estimator, for filtering the spectral estimate of the input signal to produce a filtered signal; and a switch, coupled to the voice activity detector, the spectral estimator and the filter, for selecting the spectral estimate of the input signal during the occurrences of the voice signals and the filtered signal between the occurrences of the voice signals.

11. A method for operating a radiotelephone comprising the steps of:

converting an acoustic representation of an input signal, including a noise signal and occurrences of voice signals, to an analog representation of the input signal;

converting the analog representation of the input signal to a digital representation of the input signal;

encoding the digital representation of the input signal to produce an encoded signal;

transmitting the encoded signal;

radiating, by an antenna, the encoded signal;

receiving, by the antenna, a received encoded signal, including a noise signal and occurrences of voice signals;

receiving the received encoded signal;

decoding the received encoded signal to produce a digital representation of a decoded signal;

converting the digital representation of the decoded signal to an analog representation of the decoded signal;

converting the analog representation of the decoded signal to an acoustic representation of the decoded signal;

wherein at least one of the steps of encoding and decoding further comprises a method of performing spectral analysis of the digital representation of the input signal and the received encoded signal, respectively, the method of performing spectral analysis comprising the steps of:

detecting the occurrences of voice signals in the digital representation of the input signal and the received encoded signal, respectively;

smoothing, responsive to the step of detecting, the spectrum of the digital representation of the input signal and the received encoded signal, respectively, over a first bandwidth during the occurrences of the voice signals and over a second bandwidth, substantially greater than the first bandwidth, between the occurrences of the voice signals to produce a smoothed spectrum of the digital representation of the input signal and a smoothed spectrum of the received encoded signal, respectively;

estimating, responsive to the step of smoothing, a spectrum of the smoothed spectrum of the digital representation of the input signal and the smoothed spectrum of the received encoded signal, respectively, to produce a spectral estimate of the smoothed spectrum of the digital representation of the input signal and a spectral estimate of the smoothed spectrum of the received encoded signal, respectively.

12. A radiotelephone comprising:

a microphone for converting an audible representation of an input signal, including a noise signal and occurrences of voice signals, to an analog representation of the input signal;

an analog to digital converter, coupled to the microphone, for converting the analog representation of the input signal to a digital representation of the input signal;

an encoder, coupled to the analog to digital converter, for encoding the digital representation of the input signal to produce an encoded signal;

a transmitter, coupled to the encoder, for transmitting the encoded signal;

an antenna, coupled to the transmitter, for radiating the encoded signal and for receiving a received encoded signal, including a noise signal and occurrences of voice signals;

a receiver, coupled to the antenna, for receiving the received encoded signal;

a decoder, coupled to the receiver, for decoding the received encoded signal to produce a digital representation of a decoded signal;

a digital to analog converter, coupled to the decoder, for converting the digital representation of the decoded signal to an analog representation of the decoded signal;

a speaker, coupled to the digital to analog converter, for converting the analog representation of the decoded signal to an audible representation of the decoded signal;

wherein at least one of the encoder and the decoder further comprises a spectral analyzer for performing spectral analysis of the digital representation of the input signal and the received encoded signal, respectively, the spectral analyzer comprising:

a voice activity detector, coupled to the analog to digital converter and the receiver, respectively, for detecting the occurrences of voice signals in the digital representation of the input signal and the received encoded signal, respectively;

a spectral smoother, coupled to the voice activity detector, for smoothing the spectrum of the digital representation of the input signal and the received encoded signal, respectively, over a first bandwidth during the occurrences of the voice signals and over a second bandwidth, substantially greater than the first bandwidth, between the occurrences of the voice signals to produce a smoothed spectrum of the digital representation of the input signal and a smoothed spectrum of the received encoded signal, respectively;

a spectral estimator, coupled to the spectral smoother, for estimating a spectrum of the smoothed spectrum of the digital representation of the input signal and the smoothed spectrum of the received encoded signal, respectively, to produce a spectral estimate of the smoothed spectrum of the digital representation of the input signal and a spectral estimate of the smoothed spectrum of the received encoded signal, respectively.

13. A method for operating a radiotelephone comprising the steps of:

converting an acoustic representation of an input signal, including a noise signal and occurrences of voice signals, to an analog representation of the input signal;

converting the analog representation of the input signal to a digital representation of the input signal;

encoding the digital representation of the input signal to produce an encoded signal;

transmitting the encoded signal;

radiating, by an antenna, the encoded signal;

receiving, by the antenna, a received encoded signal, including a noise signal and occurrences of voice signals;

receiving the received encoded signal;

decoding the received encoded signal to produce a digital representation of a decoded signal;

converting the digital representation of the decoded signal to an analog representation of the decoded signal;

converting the analog representation of the decoded signal to an acoustic representation of the decoded signal;

wherein at least one of the steps of encoding and decoding further comprises a method of performing spectral analysis of the digital representation of the input signal and the received encoded signal, respectively, the method of performing spectral analysis comprising the steps of:

detecting the occurrences of voice signals in the digital representation of the input signal and the received encoded signal, respectively;

estimating a spectrum of the digital representation of the input signal and the received encoded signal, respectively, to produce a spectral estimate of the digital representation of the input signal and a spectral estimate of the received encoded signal, respectively;

filtering, responsive to the step of estimating, the spectral estimate of the digital representation of the input signal and the spectral estimate of the received encoded signal, respectively, to produce a filtered digital representation of the input signal and a filtered received encoded signal, respectively; and selecting, responsive to the steps of detecting and filtering, the spectral estimate of the digital representation of the input signal and the spectral estimate of the received encoded signal, respectively, during the occurrences of the voice signals and the filtered digital representation of the input signal and the filtered received encoded signal, respectively, between the occurrences of the voice signals to produce the encoded signal and the digital representation of the decoded signal, respectively.

14. A radiotelephone comprising:

a microphone for converting an audible representation of an input signal, including a noise signal and occurrences of voice signals, to an analog representation of the input signal;

an analog to digital converter, coupled to the microphone, for converting the analog representation of the input signal to a digital representation of the input signal;

an encoder, coupled to the analog to digital converter, for encoding the digital representation of the input signal to produce an encoded signal;

a transmitter, coupled to the encoder, for transmitting the encoded signal;

an antenna, coupled to the transmitter, for radiating the encoded signal and for receiving a received encoded signal, including a noise signal and occurrences of voice signals;

a receiver, coupled to the antenna, for receiving the received encoded signal;

a decoder, coupled to the receiver, for decoding the received encoded signal to produce a digital representation of a decoded signal;

a digital to analog converter, coupled to the decoder, for converting the digital representation of the decoded signal to an analog representation of the decoded signal;

a speaker, coupled to the digital to analog converter, for converting the analog representation of the decoded signal to an audible representation of the decoded signal;

wherein at least one of the encoder and the decoder further comprises a spectral analyzer for performing spectral analysis of the digital representation of the input signal and the received encoded signal, respectively, the spectral analyzer comprising:

a voice activity detector, coupled to the analog to digital converter and the receiver, respectively, for detecting the occurrences of voice signals in the digital representation of the input signal and the received encoded signal, respectively;

a spectral estimator for estimating a spectrum of the digital representation of the input signal and the received encoded signal, respectively, to produce a spectral estimate of the digital representation of the input signal and a spectral estimate of the received encoded signal, respectively;

a filter, coupled to the spectral estimator, for filtering the spectral estimate of the digital representation of the input signal and the spectral estimate of the received encoded signal, respectively, to produce a filtered digital representation of the input signal and a filtered received encoded signal, respectively; and a switch, coupled to the voice activity detector and the filter, for selecting the spectral estimate of the digital representation of the input signal and the spectral estimate of the received encoded signal, respectively, during the occurrences of the voice signals and the filtered digital representation of the input signal and the filtered received encoded signal, respectively, between the occurrences of the voice signals to produce the encoded signal and the digital representation of the decoded signal, respectively.

15. A method for performing spectral analysis of an input signal including occurrences of voice signals, the method comprising the steps of:

estimating a spectrum of the input signal to produce a spectral estimate of the input signal including reflection coefficients;

filtering, responsive to the step of estimating, the reflection coefficients to produce a filtered signal;

processing the reflection coefficients during the occurrences of the voice signals; and processing the filtered signal between the occurrences of the voice signals.

16. A voice processing circuit comprising:

an encoder for encoding an input signal, including occurrences of voice signals, to produce an encoded signal, the encoder comprising:

a spectral estimator for producing poles representing a spectral estimate of the input signal, wherein the poles are defined by magnitude and phase components;

a voice activity detector for detecting the occurrences of voice signals in the input signal; and a pole component reducer, coupled to the spectral estimator and the voice activity detector, for reducing the significance of at least one of the magnitude and phase components of the poles between the occurrences of the voice signals to produce a modified spectral estimate of the input signal representative of the encoded signal.

17. A voice processing circuit according to claim 16 further comprising:

a decoder for decoding a received encoded signal to produce a decoded signal.

18. A voice processing circuit according to claim 17 further comprising:

an analog to digital converter, coupled to the encoder, for converting the input signal from an analog representation of the input signal to a digital representation of the input signal; and a digital to analog converter, coupled to the decoder, for converting the decoded signal from a digital representation of the decoded signal to an analog representation of the decoded signal.

19. A voice processing circuit according to claim 17 further comprising:

a transmitter circuit for transmitting the encoded signal; and a receiver circuit for receiving the received encoded signal.

20. A voice processing circuit according to claim 16 wherein the pole component reducer of the encoder further comprises:

a spectral smoother, coupled to an input of the spectral estimator and the voice activity detector, for smoothing the spectrum of the input signal over a first bandwidth during the occurrences of the voice signals to produce a first smoothed spectrum of the input signal representative of the encoded signal and for smoothing the spectrum of the input signal over a second bandwidth, substantially greater than the first bandwidth, between the occurrences of the voice signals to produce a second smoothed spectrum of the input signal representative of the encoded signal.

21. A voice processing circuit according to claim 20 further comprising:

a decoder for decoding a received encoded signal to produce a decoded signal.

22. A voice processing circuit according to claim 21 further comprising:

an analog to digital converter, coupled to the encoder, for converting the input signal from an analog representation of the input signal to a digital representation of the input signal; and a digital to analog converter, coupled to the decoder, for converting the decoded signal from a digital representation of the decoded signal to an analog representation of the decoded signal.

23. A voice processing circuit according to claim 21 further comprising:

a transmitter circuit for transmitting the encoded signal; and a receiver circuit for receiving the received encoded signal.

24. A voice processing circuit according to claim 16 wherein the pole component reducer of the encoder further comprises:

a filter, coupled to an output of the spectral estimator, for filtering the spectral estimate of the input signal to produce a filtered signal; and a switch, coupled to the voice activity detector, the spectral estimator and the filter, for selecting the spectral estimate of the input signal during the occurrences of the voice signals to represent the encoded signal and the filtered signal between the occurrences of the voice signals to represent the encoded signal.

25. A voice processing circuit according to claim 24 further comprising:

a decoder for decoding a received encoded signal to produce a decoded signal.

26. A voice processing circuit according to claim 25 further comprising:

an analog to digital converter, coupled to the encoder, for converting the input signal from an analog representation of the input signal to a digital representation of the input signal; and a digital to analog converter, coupled to the decoder, for converting the decoded signal from a digital representation of the decoded signal to an analog representation of the decoded signal.

27. A voice processing circuit according to claim 25 further comprising:

a transmitter circuit for transmitting the encoded signal; and a receiver circuit for receiving the received encoded signal.

28. A voice processing circuit comprising:

an encoder for encoding an input signal, including occurrences of voice signals, to produce an encoded signal, the encoder comprising:

a spectral estimator for estimating a spectrum of the input signal to produce a spectral estimate of the input signal, wherein the spectral estimate includes reflection coefficients;

a filter for filtering the reflection coefficients to produce a filtered signal; and a processor for processing the reflection coefficients during the occurrences of the voice signals to represent the encoded signal and for processing the filtered signal between the occurrences of the voice signals to represent the encoded signal.

29. A voice processing circuit according to claim 28 further comprising:

a decoder for decoding a received encoded signal to produce a decoded signal.

30. A voice processing circuit according to claim 29 further comprising:

an analog to digital converter, coupled to the encoder, for converting the input signal from an analog representation of the input signal to a digital representation of the input signal; and a digital to analog converter, coupled to the decoder, for converting the decoded signal from a digital representation of the decoded signal to an analog representation of the decoded signal.

31. A voice processing circuit according to claim 29 further comprising:

a transmitter circuit for transmitting the encoded signal; and a receiver circuit for receiving the received encoded signal.

* * * * *